US011525098B2

(12) United States Patent
Narayanan et al.

(10) Patent No.: US 11,525,098 B2
(45) Date of Patent: Dec. 13, 2022

(54) FUEL ADDITIVE COMPOSITION, FUEL COMPOSITION, AND PROCESS FOR PREPARATION THEREOF

(71) Applicant: Hindustan Petroleum Corporation Limited, Bangalore (IN)

(72) Inventors: Krishnamurthy Narayanan, Bangalore (IN); Sandip Bhowmik, Bangalore (IN); Ramkumar Mangala, Bangalore (IN); Ramachandrarao Bojja, Bangalore (IN); Sriganesh Gandham, Bangalore (IN)

(73) Assignee: Hindustan Petroleum Corporation Limited, Bangalore (IN)

( * ) Notice: Subject to any disclaimer, the term of this patent is extended or adjusted under 35 U.S.C. 154(b) by 0 days.

(21) Appl. No.: 17/434,613

(22) PCT Filed: Mar. 26, 2020

(86) PCT No.: PCT/IN2020/050283
§ 371 (c)(1),
(2) Date: Aug. 27, 2021

(87) PCT Pub. No.: WO2020/208646
PCT Pub. Date: Oct. 15, 2020

(65) Prior Publication Data

US 2022/0041946 A1 Feb. 10, 2022

(30) Foreign Application Priority Data

Apr. 10, 2019 (IN) ..... 201941014554

(51) Int. Cl.

| | |
|---|---|
| ***C10L 3/12*** | (2006.01) |
| ***C10L 1/18*** | (2006.01) |
| ***C10L 1/22*** | (2006.01) |
| ***C10L 1/30*** | (2006.01) |

(52) U.S. Cl.
CPC ..... *C10L 3/12* (2013.01); *C10L 1/1811* (2013.01); *C10L 1/22* (2013.01); *C10L 1/305* (2013.01); *C10L 2270/08* (2013.01); *C10L 2300/30* (2013.01)

(58) Field of Classification Search
CPC ..... C10L 1/1811; C10L 1/22; C10L 1/305; C10L 3/12
See application file for complete search history.

(56) References Cited

U.S. PATENT DOCUMENTS

| | | | | |
|---|---|---|---|---|
| 816,304 | A | 3/1906 | Delehant | |
| 3,741,135 | A * | 6/1973 | Thompson | F23D 99/00 431/344 |
| 4,585,462 | A | 4/1986 | Kitchen | |
| 5,516,377 | A * | 5/1996 | Highsmith | C06D 5/06 149/109.2 |
| 6,187,067 | B1 | 2/2001 | Guimaraes et al. | |
| 6,224,697 | B1 | 5/2001 | Mendenhall et al. | |
| 7,083,690 | B2 * | 8/2006 | Dobbins | C06B 47/02 149/109.6 |
| 7,282,573 | B2 * | 10/2007 | Chaudhuri | C07C 45/77 534/11 |
| 8,163,042 | B2 * | 4/2012 | Rao | C10L 3/12 44/361 |

FOREIGN PATENT DOCUMENTS

| | | | | |
|---|---|---|---|---|
| CN | 1431282 | A | 7/2003 | |
| CN | 1800319 | A | 7/2006 | |
| CN | 1800320 | A | 7/2006 | |
| CN | 100427575 | C | 10/2008 | |
| CN | 102634393 | A | 8/2012 | |
| CN | 103497799 | A | 1/2014 | |
| CN | 103525489 | A | 1/2014 | |
| DE | 1901919 | A1 * | 8/1970 | C08F 283/01 |
| DE | 1901919 | A1 * | 8/1970 | |
| EP | 0565715 | A1 | 10/1993 | |
| EP | 0734430 | B1 | 6/2004 | |
| FR | 2418058 | A1 | 9/1979 | |
| WO | WO-2008/072254 | A2 | 6/2009 | |

OTHER PUBLICATIONS

Machine Translation of Abstractor DE1901919A1 (Year: 1970).*
ADLASSNIG (Machine Translation of DE 1901919A1) (Year: 1970).*
International Search Report & Written Opinion for PCT/IB2020/050283 dated Jul. 22, 2020, 11 pgs.

* cited by examiner

*Primary Examiner* — Ellen M McAvoy
*Assistant Examiner* — Ming Cheung Po
(74) *Attorney, Agent, or Firm* — Blank Rome LLP

(57) ABSTRACT

The present disclosure describes an additive composition comprising: (a) an organometallic compound; (b) a nitrogen-containing compound; (c) an aryl peroxide; and (d) at least one solvent, wherein the organometallic compound to the nitrogen-containing compound to the aryl peroxide weight ratio is in a range of 7:0.5:0.5-9:1.5:1.5. The addition of additive composition not only synergistically improves the properties of the at least one fuel, such as, LPG for use as torch gas for cutting and welding application, but also reduces the consumption of both fuel and oxygen for cutting applications. The present disclosure is also directed towards a process for preparation of the fuel composition.

10 Claims, No Drawings

FUEL ADDITIVE COMPOSITION, FUEL COMPOSITION, AND PROCESS FOR PREPARATION THEREOF

RELATED APPLICATIONS

The present application is a national phase of PCT/IN2020/050283, filed Mar. 26, 2020, which claims the benefit of Indian Patent Application No. 201941014554, filed Apr. 10, 2019. The entire disclosures of which are hereby incorporated by reference.

FIELD OF INVENTION

The present disclosure relates to the field of fuel composition, and in particular relates to fuel additive composition for use in oxyfuel-cutting and welding applications.

BACKGROUND OF THE INVENTION

Oxyfuel cutting is a process that uses hydrocarbon fuel gas such as acetylene, propane, propylene, butane, or natural gas and oxygen to cut metals. This is essentially a chemical reaction between pure oxygen and metal (steel) to form metal oxide (iron oxide) at an elevated temperature. This thermal cutting process is the most extensively used in industries because it can cut metal plates having thicknesses ranging from 0.5 mm to 500 mm or more. The cutting process begins by using a mixture of oxygen and the fuel gas to preheat the metal to its 'ignition' temperature (for instance 700° C.-900° C. for steel; bright red heat) but well below its melting point. A cutting oxygen stream is then directed at the preheated spot, causing rapid oxidation of the heated metal. This will generate large amount of heat due to exothermicity of the reaction. This heat supports continued oxidation of the metal as the cut progresses. Combusted gas and the pressurized oxygen jet flush the molten oxide away, exposing fresh surfaces for cutting. The metal in the path of the oxygen jet burns. The cut progresses, making a narrow slot, or kerf, through the metal.

Conventionally, acetylene is the fuel of choice for general cutting and welding due to its high flame temperature, flame propagation rate, and higher amount of energy released during combustion compared to other hydrocarbon fuels such as propane, propylene, natural gas, etc. However, there are certain shortcoming in using acetylene, such as, expensive (like torch gas), slag formation, difficult to store and to transport, and back firing tendency etc. To overcome the above-mentioned drawbacks, alternative fuel gases, such as propylene, have been used for cutting and welding applications. However, these fuel gases do not provide cutting velocities equal to or greater than those obtained by the acetylene, since they present an oxygen consumption superior to that presented by the acetylene. To overcome these drawbacks, various attempts have been made to improve the properties of the fuel gas for use in cutting and/or welding torches by adding an additive or a double additive to base fuel. For instance, U.S. Pat. No. 6,187,067 discloses an additivated gas for oxy-cutting and/or heating applications comprising of propylene additivated with a chemical product selected from the group consisting of C9-C10 aromatic compounds, C6-C12 paraffins, and C9-C10 naphthenic compounds.

EP0734430 discloses a hydrogen torch gas comprising an additive selected from at least one alcohol component, and at least a second component selected from the group consisting of ethylene glycol dimethyl ether, ethyl acetate, methyl ethyl ketone and butyraldehyde. U.S. Pat. No. 816,304 discloses the use of an organometallic compound, and optionally substituted aniline and toluidine as an additive to base fuel for use as torch gas. CN1800319 discloses a liquefied petroleum gas additive comprising ethyoxyl nonyl phenol, and anhydrous aliphatic ether for improving the efficiency of combustion. CN102634393 discloses an energy-saving additive for liquefied petroleum cutting gas comprising iron naphthenate, methyl tertiary butyl ether, n-hexane, 2,2-di-(ethyl ferrocene) propane, methyl alcohol, isooctyl nitrate, isopropyl-ketone and naphtha as a solvent. CN100427575 discloses the use of liquefied petroleum gas additives comprising an organic peroxide, methylcyclopentadienyl manganese tricarbonyl, iron or nickel sandwich compound, ethanol, benzyl alcohol, benzene and petroleum ether for use as a torch gas.

Although numerous attempts have been made in the past, there still exists a need to develop cost-effective fuel compositions which can reduce consumption of expensive fuel or oxygen and can impart characteristics superior to that of acetylene for cutting and welding applications.

SUMMARY OF THE INVENTION

In an aspect of the present disclosure, there is provided an additive composition comprising: (a) an organometallic compound; (b) a nitrogen-containing compound; (c) an aryl peroxide; and (d) at least one solvent, wherein the organometallic compound to the nitrogen-containing compound to the aryl peroxide weight ratio is in a range of 7:0.5:0.5-9:1.5:1.5.

In another aspect of the present disclosure, there is provided a process for obtaining the additive composition comprising: (a) an organometallic compound; (b) a nitrogen-containing compound; (c) an aryl peroxide; and (d) at least one solvent, wherein the organometallic compound to the nitrogen-containing compound to the aryl peroxide weight ratio is in a range of 7:0.5:0.5-9:1.5:1.5, said process comprising: (a) obtaining the organometallic compound; (b) obtaining the nitrogen-containing compound; (c) obtaining the aryl peroxide; and (d) contacting the organometallic compound, the nitrogen-containing compound, the aryl peroxide and the at least one solvent to obtain the additive composition.

In yet another aspect of the present disclosure, there is provided a fuel composition comprising: (a) at least one base fuel; (b) an organometallic compound having a concentration in a range of 2-100 ppm with respect to LPG; (c) a nitrogen-containing compound having a concentration in a range of 5-50 ppm with respect to LPG; (d) an aryl peroxide having a concentration in a range of 1-10 ppm with respect to LPG; and (e) at least one solvent having a concentration in a range of 0.01-5%

In another aspect of the present disclosure, there is provided a process for obtaining the fuel composition comprising: (a) at least one base fuel; (b) an organometallic compound; (c) a nitrogen-containing compound; (d) an aryl peroxide; and (e) at least one solvent, said process comprising: (i) obtaining the organometallic compound; (ii) obtaining the nitrogen-containing compound; (iii) obtaining the aryl peroxide; and (iv) contacting the organometallic compound, the nitrogen-containing compound, the aryl peroxide and the at least one solvent in the presence of LPG to obtain the additive composition.

These and other features, aspects, and advantages of the present subject matter will be better understood with reference to the following description and appended claims. This summary is provided to introduce a selection of concepts in a simplified form. This summary is not intended to identify key features or essential features of the claimed subject matter, nor is it intended to be used to limit the scope of the claimed subject matter.

DETAILED DESCRIPTION OF THE INVENTION

Those skilled in the art will be aware that the present disclosure is subject to variations and modifications other than those specifically described. It is to be understood that the present disclosure includes all such variations and modifications. The disclosure also includes all such steps, features, compositions, and compounds referred to or indicated in this specification, individually or collectively, and any and all combinations of any or more of such steps or features.

Definitions

For convenience, before further description of the present disclosure, certain terms employed in the specification, and examples are collected here. These definitions should be read in the light of the remainder of the disclosure and understood as by a person of skill in the art. The terms used herein have the meanings recognized and known to those of skill in the art, however, for convenience and completeness, particular terms and their meanings are set forth below.

The articles "a", "an" and "the" are used to refer to one or to more than one (i.e., to at least one) of the grammatical object of the article.

The terms "comprise" and "comprising" are used in the inclusive, open sense, meaning that additional elements may be included. It is not intended to be construed as "consists of only".

Throughout this specification, unless the context requires otherwise the word "comprise", and variations such as "comprises" and "comprising", will be understood to imply the inclusion of a stated element or step or group of element or steps but not the exclusion of any other element or step or group of element or steps.

The term "including" is used to mean "including but not limited to". "Including" and "including but not limited to" are used interchangeably.

Ratios, concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a concentration range of about 2-100 ppm should be interpreted to include not only the explicitly recited limits of about 2 ppm to about 100 ppm, but also to include sub-ranges, such as 10 ppm, 500 ppm, 75 ppm, and so forth, as well as individual amounts, including fractional amounts, within the specified ranges, such as 10.5 ppm, and 25.7 ppm, for example.

The term "at least one base fuel" refers to any fuel, such as Liquified Petroleum Gas, $C_{3-4}$ fuels (propane, propylene, butane, isobutane, butylene, isobutylene and the like).

The term "arylamine" refers to an aromatic amine having the structure Ar—NRR', wherein Ar represents an aryl group and R and R' are groups that may be independently selected from hydrogen and substituted and unsubstituted alkyl, alkenyl, aryl. Preferred arylamine include, without limitation, alkylaniline, dimethylaniline, methylethyl aniline, methylpropylaniline.

The term "aryl peroxide" refers to organic compound containing the peroxide functional group (ROOR'), where R and/or R' is an aryl group.

Unless defined otherwise, all technical and scientific terms used herein have the same meaning as commonly understood by one of ordinary skill in the art to which this disclosure belongs. Although any methods and materials similar or equivalent to those described herein can be used in the practice or testing of the disclosure, the preferred methods, and materials are now described. All publications mentioned herein are incorporated herein by reference.

The present disclosure is not to be limited in scope by the specific implementations described herein, which are intended for the purposes of exemplification only. Functionally-equivalent products, compositions, and methods are clearly within the scope of the disclosure, as described herein.

In the recent years, propylene is being increasingly used as a choice of fuel gas for cutting and welding applications. Although less expensive than acetylene, propylene requires higher oxygen consumption to lower the flame, and a cutting velocity is much lower than acetylene. Although, recent trends suggest the addition of additives to the fuel compositions, to overcome the cited drawbacks, there still exists a need to develop fuel composition having higher cutting velocities, a lower oxygen and fuel gas consumption, as well as having a low cost of production. Therefore, the principle object of the present disclosure is to provide a fuel composition for increasing the combustion efficiency of the fuel gas, such as Liquified Petroleum Gas (LPG); and enable cutting of the ferrous metal though an economically faster and safer manner. Another object of the present disclosure is to reduce the consumption of fuel used as torch gas for cutting and/or welding applications. Still another object of the present disclosure is to reduce the consumption of oxygen for cutting and welding applications. The present disclosure provides an additive composition comprising an organometallic compound, a nitrogen-containing compound, and an alcohol. The additive composition when added to the fuel gas, such as LPG, not only synergistically improves the properties of the base fuel for use as torch gas for cutting and welding application, but also reduces the consumption of both fuel and oxygen for cutting applications.

In an embodiment of the present disclosure, there is disclosed an additive composition comprising: (a) an organometallic compound; (b) a nitrogen-containing compound; (c) an aryl peroxide; and (d) at least one solvent, wherein the organometallic compound to the nitrogen-containing compound to the aryl peroxide weight ratio is in a range of 7:0.5:0.5-9:1.5:1.5. In another embodiment of the present disclosure, the organometallic compound to the nitrogen-containing compound to the aryl peroxide weight ratio is in the range of 7.5:1:1-8.5:1:1.

In an embodiment of the present disclosure, there is provided an additive composition as described herein, wherein the organometallic compound is a metal acetylacetonate. In another embodiment of the present disclosure, the organometallic compound is at least one of a nickel acetyl acetonate, cobalt acetyl acetonate, and iron acetyl acetonate.

In an embodiment of the present disclosure, there is provided an additive composition comprising: (a) an organometallic compound; (b) a nitrogen-containing compound;

(c) an aryl peroxide; and (d) at least one solvent, wherein the organometallic compound to the nitrogen-containing compound to the aryl peroxide weight ratio is in a range of 7:0.5:0.5-9:1.5:1.5, and wherein the organometallic compound is a metal acetylacetonate.

In an embodiment of the present disclosure, there is provided an additive composition as described herein, wherein the metal in the metal acetylacetonate is selected from the group consisting of Fe, Al, V, Cr, Mn, Fe, Co, Ni, Cu, Zn, La, Ce, and combinations thereof. In another embodiment, the metal in the metal acetylacetonate is Ni, Co and Fe.

In an embodiment of the present disclosure, there is provided an additive composition comprising: (a) an organometallic compound; (b) a nitrogen-containing compound; (c) an aryl peroxide; and (d) at least one solvent, wherein the organometallic compound to the nitrogen-containing compound to the aryl peroxide weight ratio is in a range of 7:0.5:0.5-9:1.5:1.5, and wherein the organometallic compound is metal acetylacetonate, and wherein the metal in the metal acetylacetonate is Ni, Co and Fe.

In an embodiment of the present disclosure, there is provided an additive composition as described herein, wherein the nitrogen-containing compound is an aryl amine. In another embodiment, the nitrogen-containing compound is dimethyl aniline.

In an embodiment of the present disclosure, there is provided an additive composition comprising: (a) an organometallic compound; (b) a nitrogen-containing compound; (c) an aryl peroxide; and (d) at least one solvent, wherein the organometallic compound to the nitrogen-containing compound to the aryl peroxide weight ratio is in a range of 7:0.5:0.5-9:1.5:1.5, and wherein the nitrogen-containing compound is an aryl amine.

In an embodiment of the present disclosure, there is provided an additive composition comprising: (a) an organometallic compound; (b) a nitrogen-containing compound; (c) an aryl peroxide; and (d) at least one solvent, wherein the organometallic compound to the nitrogen-containing compound to the aryl peroxide weight ratio is in a range of 7:0.5:0.5-9:1.5:1.5, and wherein the organometallic compound is metal acetylacetonate, and wherein the nitrogen-containing compound is an aryl amine.

In an embodiment of the present disclosure, there is provided an additive composition as described herein, wherein the aryl peroxide is at least one selected from a group consisting of benzoyl peroxide, tetralin hydroperoxide, and (1-naphthyl)(tert-butyl) peroxide. In another embodiment of the present disclosure, the at least one aryl peroxide is benzoyl peroxide.

In an embodiment of the present disclosure, there is provided an additive composition comprising: (a) an organometallic compound; (b) a nitrogen-containing compound; (c) an aryl peroxide; and (d) at least one solvent, wherein the organometallic compound to the nitrogen-containing compound to the aryl peroxide weight ratio is in a range of 7:0.5:0.5-9:1.5:1.5, and wherein the aryl peroxide is benzoyl peroxide.

In an embodiment of the present disclosure, there is provided an additive composition comprising: (a) an organometallic compound; (b) a nitrogen-containing compound; (c) an aryl peroxide; and (d) at least one solvent, wherein the organometallic compound to the nitrogen-containing compound to the aryl peroxide weight ratio is in a range of 7:0.5:0.5-9:1.5:1.5, the organometallic compound is metal acetylacetonate, and wherein the nitrogen-containing compound is an aryl amine; and the aryl peroxide is at least one selected from a group consisting of benzoyl peroxide, tetralin hydroperoxide, and (1-naphthyl)(tert-butyl) peroxide.

In an embodiment of the present disclosure, there is provided an additive composition as described herein, wherein the at least one solvent is a combination of: a) a hydrophobic solvent selected from the group consisting of naphtha, gasoline, mineral turpentine oil, kerosene, and combinations thereof; and b) an oxygen-containing solvent selected from $C_{1-6}$ alcohol, $C_{3-6}$ ketone or $C_{2-6}$ ether. In said embodiment, gasoline or naphtha has a boiling range of 40° C.-140° C., mineral turpentine oil has boiling range of 140° C.-240° C., kerosene has a boiling range of 140° C.-280° C. $C_{1-6}$ alcohols include linear or branched alcohols selected from a group consisting of methanol, ethanol, propanol, butanol, pentanol, hexanol isopropanol, isobutanol, t-butanol, and combinations thereof. $C_{3-6}$ ketones includes ketones selected from a group consisting of propanone, butanone, pentanone methyl ethyl ketone, acetyl acetone and combinations thereof. $C_{2-6}$ ether includes ethers selected from a group consisting of dimethyl ether, methyl ethyl ether, diethyl ether, dipropyl ether, methyl propyl ether, methyl-t-butyl ether, and combinations thereof. In another embodiment, the at least one solvent naptha/mineral turpentine oil/kerosene, or combinations thereof, in combination with isopropanol. In an embodiment, the at least one solvent has a concentration in the range of 0.01-5% with respect to the composition.

In an embodiment of the present disclosure, there is provided an additive composition comprising: (a) an organometallic compound; (b) a nitrogen-containing compound; (c) an aryl peroxide; and (d) at least one solvent, wherein the organometallic compound to the nitrogen-containing compound to the aryl peroxide weight ratio is in a range of 7:0.5:0.5-9:1.5:1.5, and wherein the at least one solvent is a combination of: a) a hydrophobic solvent selected from the group consisting of naphtha, gasoline, mineral turpentine oil, kerosene, and combinations thereof; and b) an oxygen-containing solvent selected from $C_{1-6}$ alcohol, $C_{3-6}$ ketone or $C_{2-6}$ ether.

In an embodiment of the present disclosure, there is provided an additive composition comprising: (a) an organometallic compound; (b) a nitrogen-containing compound; (c) an aryl peroxide; and (d) at least one solvent, wherein the organometallic compound to the nitrogen-containing compound to the aryl peroxide weight ratio is in a range of 7:0.5:0.5-9:1.5:1.5; wherein the organometallic compound is metal acetylacetonate; the nitrogen-containing compound is an aryl amine; the aryl peroxide is selected from a group consisting of benzoyl peroxide, tetralin hydroperoxide, and (1-naphthyl)(tert-butyl) peroxide, and combinations thereof; and the at least one solvent is a combination of: a) a hydrophobic solvent selected from the group consisting of naphtha, gasoline, mineral turpentine oil, kerosene, and combinations thereof; and b) an oxygen-containing solvent selected from $C_{1-6}$ alcohol, $C_{3-6}$ ketone or $C_{2-6}$ ether.

In an embodiment of the present disclosure, there is provided a process for obtaining the additive composition comprising: (a) an organometallic compound; (b) a nitrogen-containing compound; (c) an aryl peroxide; and (d) at least one solvent, wherein the organometallic compound to the nitrogen-containing compound to the aryl peroxide weight ratio is in a range of 7:0.5:0.5-9:1.5:1.5, said process comprising: (i) obtaining the organometallic compound; (ii) obtaining the nitrogen-containing compound; (iii) obtaining the aryl peroxide; and (iv) contacting the organometallic compound, the nitrogen-containing compound, the aryl peroxide and the at least one solvent to obtain the additive composition.

In an embodiment of the present disclosure, there is provided a process for obtaining the additive composition comprising: (a) an organometallic compound; (b) a nitrogen-containing compound; (c) an aryl peroxide; and (d) at least one solvent, wherein the organometallic compound to the nitrogen-containing compound to the aryl peroxide weight ratio is in a range of 7:0.5:0.5-9:1.5:1.5, wherein the organometallic compound is metal acetylacetonate, the nitrogen-containing compound is an aryl amine, the aryl peroxide is at least one selected from a group consisting of benzoyl peroxide, tetralin hydroperoxide, and (1-naphthyl)(tert-butyl) peroxide, and combinations thereof; the at least one solvent is a combination of: a) a hydrophobic solvent selected from the group consisting of naphtha, gasoline, mineral turpentine oil, kerosene, and combinations thereof; and b) an oxygen-containing solvent selected from $C_{1-6}$ alcohol, $C_{3-6}$ ketone or $C_{2-6}$ ether, said process comprising: (i) obtaining the organometallic compound; (ii) obtaining the nitrogen-containing compound; (iii) obtaining the aryl peroxide; and (iv) contacting the organometallic compound, the nitrogen-containing compound, the aryl peroxide and the at least one solvent to obtain the additive composition.

In an embodiment of the present disclosure, there is provided a fuel composition comprising: a) Liquified Petroleum gas (LPG); b) an organometallic compound; c) a nitrogen-containing compound; d) an aryl peroxide; and e) at least one solvent, wherein the organometallic compound to the nitrogen-containing compound to the aryl peroxide weight ratio is in a range of 7:0.5:0.5-9:1.5:1.5. In another embodiment of the present disclosure, the organometallic compound to the nitrogen-containing compound to the aryl peroxide weight ratio is in a range of 7.5:1:1-8.5:1:1. In yet another embodiment, the organometallic compound to the nitrogen-containing compound to the aryl peroxide weight ratio is 8:1:1.

In an embodiment of the present disclosure, there is provided a fuel composition as described herein, wherein the organometallic compound is a metal acetylacetonate. In another embodiment of the present disclosure, the metal acetyl acetonate is at least one selected from a group consisting of iron acetyl acetonate, nickel acetyl acetonate, and cobalt acetyl acetonate.

In an embodiment of the present disclosure, there is provided a fuel composition comprising: a) Liquified Petroleum gas (LPG); b) an organometallic compound; c) a nitrogen-containing compound; d) an aryl peroxide; and e) at least one solvent, wherein the organometallic compound to the nitrogen-containing compound to the aryl peroxide weight ratio is in a range of 7:0.5:0.5-9:1.5:1.5, wherein the organometallic compound is a metal acetylacetonate.

In an embodiment of the present disclosure, there is provided a fuel composition as described herein, wherein the organometallic compound is a metal acetylacetonate, and wherein the metal in the metal acetylacetonate is selected from the group consisting of Fe, Al, V, Cr, Mn, Fe, Co, Ni, Cu, Zn, La, Ce, and combinations thereof.

In an embodiment of the present disclosure, there is provided a fuel composition comprising: a) Liquified Petroleum gas (LPG); b) an organometallic compound; c) a nitrogen-containing compound; d) an aryl peroxide; and e) at least one solvent, wherein the organometallic compound to the nitrogen-containing compound to the aryl peroxide weight ratio is in a range of 7:0.5:0.5-9:1.5:1.5, wherein the organometallic compound is a metal acetylacetonate, and wherein the metal in the metal acetylacetonate is selected from the group consisting of Fe, Al, V, Cr, Mn, Fe, Co, Ni, Cu, Zn, La, Ce, and combinations thereof.

In an embodiment of the present disclosure, there is provided a fuel composition as described herein, wherein the nitrogen-containing compound is an aryl amine. In another embodiment of the present disclosure, the nitrogen-containing compound is dimethyl aniline.

In an embodiment of the present disclosure, there is provided a fuel composition comprising: a) Liquified Petroleum gas (LPG); b) an organometallic compound; c) a nitrogen-containing compound; d) an aryl peroxide; and e) at least one solvent, wherein the organometallic compound to the nitrogen-containing compound to the aryl peroxide weight ratio is in a range of 7:0.5:0.5-9:1.5:1.5, wherein the organometallic compound is a metal acetylacetonate, and wherein the metal in the metal acetylacetonate is selected from the group consisting of Fe, Al, V, Cr, Mn, Fe, Co, Ni, Cu, Zn, La, Ce, and combinations thereof; and wherein the nitrogen-containing compound is an aryl amine.

In an embodiment of the present disclosure, there is provided a fuel composition as described herein, wherein the aryl peroxide is at least one selected from benzoyl peroxide, tetralin hydroperoxide, (1-naphthyl)(tert-butyl) peroxide and combinations thereof. In another embodiment of the present disclosure, the nitrogen-containing compound is benzoyl peroxide.

In an embodiment of the present disclosure, there is provided a fuel composition comprising: a) Liquified Petroleum gas (LPG); b) an organometallic compound; c) a nitrogen-containing compound; d) an aryl peroxide; and e) at least one solvent, wherein the organometallic compound to the nitrogen-containing compound to the aryl peroxide weight ratio is in a range of 7:0.5:0.5-9:1.5:1.5, wherein the organometallic compound is a metal acetylacetonate, and wherein the metal in the metal acetylacetonate is selected from the group consisting of Fe, Al, V, Cr, Mn, Fe, Co, Ni, Cu, Zn, La, Ce, and combinations thereof; the nitrogen-containing compound is an aryl amine; and the aryl peroxide is at least one selected from benzoyl peroxide, tetralin hydroperoxide, (1-naphthyl)(tert-butyl) peroxide, and combinations thereof.

In an embodiment of the present disclosure, there is provided a fuel composition as described herein, wherein the at least one solvent is a combination of: a) a hydrophobic solvent selected from the group consisting of naphtha, gasoline, mineral turpentine oil, kerosene, and combinations thereof; and b) an oxygen-containing solvent selected from $C_{1-6}$ alcohol, $C_{3-6}$ ketone or $C_{2-6}$ ether. In said embodiment, gasoline or naphtha has a boiling range of 40° C.-140° C., mineral turpentine oil has boiling range of 140° C.-240° C., kerosene has a boiling range of 140° C.-280° C. $C_{1-6}$ alcohols include linear or branched alcohols selected from a group consisting of methanol, ethanol, propanol, butanol, pentanol, hexanol isopropanol, isobutanol, tertiary butanol and combinations thereof. $C_{3-6}$ ketones includes ketones selected from a group consisting of propanone, butanone, pentanone methyl ethyl ketone, acetyl acetone and combinations thereof. $C_{2-6}$ ether includes ethers selected from a group consisting of dimethyl ether, methyl ethyl ether, diethyl ether, disopropyl ether, methyl propyl ether, methyl terbutyl ether and combinations thereof. In embodiment, the oxygen-containing solvent is selected from a group consisting of $C_{3-6}$ ketones including propanone, butanone, pentanone methyl ethyl ketone, acetyl acetone and combinations thereof. In another embodiment, the at least one solvent naptha/mineral turpentine oil/kerosene, or combinations thereof, in combination with isopropanol.

In an embodiment of the present disclosure, there is provided a fuel composition comprising: a) Liquified Petroleum gas (LPG); b) an organometallic compound; c) a nitrogen-containing compound; d) an aryl peroxide; and e) at least one solvent, wherein the organometallic compound to the nitrogen-containing compound to the aryl peroxide weight ratio is in a range of 7:0.5:0.5-9:1.5:1.5, wherein the organometallic compound is a metal acetylacetonate, the metal in the metal acetylacetonate is selected from the group consisting of Fe, Al, V, Cr, Mn, Fe, Co, Ni, Cu, Zn, La, Ce, and combinations thereof; the nitrogen-containing compound is an aryl amine, the aryl peroxide is at least one selected from benzoyl peroxide, tetralin hydroperoxide, (1-naphthyl)(tert-butyl) peroxide, and combinations thereof; the at least one solvent is a combination of: a) a hydrophobic solvent selected from the group consisting of naphtha, gasoline, mineral turpentine oil, kerosene, and combinations thereof; and b) an oxygen-containing solvent selected from $C_{1-6}$ alcohol, $C_{3-6}$ ketone or $C_{2-6}$ ether.

In an embodiment of the present disclosure, there is provided a fuel composition comprising: (a) LPG; (b) an organometallic compound having a concentration in a range of 2-100 ppm with respect to LPG; (c) a nitrogen-containing compound having a concentration in a range of 5-50 ppm with respect to LPG; (d) an aryl peroxide having a concentration in a range of 1-10 ppm with respect to LPG; and (e) at least one solvent having a concentration in a range of 0.01-5%, and wherein the organometallic compound to the nitrogen-containing compound to the aryl peroxide weight ratio is in a range of 7:0.5:0.5-9:1.5:1.5. In another embodiment of the present disclosure, there is provided a fuel composition comprising: (a) LPG; (b) an organometallic compound having a concentration in a range of 5-25 ppm with respect to LPG; (c) a nitrogen-containing compound having a concentration in a range of 10-30 ppm with respect to LPG; (d) an aryl peroxide having a concentration in a range of 5-10 ppm with respect to LPG; and (e) at least one solvent having a concentration in a range of 1-5%, and wherein the organometallic compound to the nitrogen-containing compound to the aryl peroxide weight ratio is in a range of 7:0.5:0.5-9:1.5:1.5.

In an embodiment of the present disclosure, there is provided a fuel composition as described herein, wherein: a) the organometallic compound having a concentration of 20 ppm with respect to LPG; b) the nitrogen-containing compound having a concentration of 20 ppm with respect to LPG; and c) an aryl peroxide having a concentration of 20 ppm with respect to LPG, and wherein the organometallic compound to the nitrogen-containing compound to the aryl peroxide weight ratio is in a range of 7:0.5:0.5-9:1.5:1.5.

In an embodiment of the present disclosure, there is provided a fuel composition comprising: (a) at least one base fuel; (b) an organometallic compound having a concentration of 20 ppm with respect to LPG; (c) a nitrogen-containing compound having a concentration of 20 ppm with respect to LPG; (d) an aryl peroxide having a concentration of 20 ppm with respect to LPG; and (e) at least one solvent having a concentration in a range of 0.01-5%, wherein the organometallic compound to the nitrogen-containing compound to the aryl peroxide weight ratio is in a range of 7:0.5:0.5-9:1.5:1.5.

In an embodiment of the present disclosure, there is provided a fuel composition comprising: (a) at least one base fuel; (b) an organometallic compound having a concentration of 20 ppm with respect to LPG; (c) a nitrogen-containing compound having a concentration of 20 ppm with respect to LPG; (d) an aryl peroxide having a concentration of 20 ppm with respect to LPG; and (e) at least one solvent having a concentration in a range of 0.01-3%, wherein the organometallic compound to the nitrogen-containing compound to the aryl peroxide weight ratio is in a range of 7:0.5:0.5-9:1.5:1.5.

In an embodiment of the present disclosure, there is provided a fuel composition comprising: (a) at least one base fuel; (b) an organometallic compound having a concentration of 20 ppm with respect to LPG; (c) a nitrogen-containing compound having a concentration of 20 ppm with respect to LPG; (d) an aryl peroxide having a concentration of 20 ppm with respect to LPG; and (e) at least one solvent having a concentration of 0.2%, wherein the organometallic compound to the nitrogen-containing compound to the aryl peroxide weight ratio is in a range of 7:0.5:0.5-9:1.5:1.5.

In an embodiment of the present disclosure, there is provided a process for obtaining the fuel composition comprising: (a) at least one base fuel; (b) an organometallic compound having a concentration in a range of 2-100 ppm with respect to LPG; (c) a nitrogen-containing compound having a concentration in a range of 5-50 ppm with respect to LPG; (d) an aryl peroxide having a concentration in a range of 1-10 ppm with respect to LPG; and (e) at least one solvent having a concentration in a range of 0.01-5%, said process comprising: (i) obtaining the organometallic compound; (ii) obtaining the nitrogen-containing compound; (iii) obtaining the aryl peroxide; and (iv) contacting the organometallic compound, the nitrogen-containing compound, the aryl peroxide and the at least one solvent in the presence of LPG to obtain the additive composition.

In an embodiment of the present disclosure, there is provided a composition as described herein, wherein said composition for use in metal cutting and welding applications.

Although the subject matter has been described with reference to specific embodiments, this description is not meant to be construed in a limiting sense. Various modifications of the disclosed embodiments, as well as alternate embodiments of the subject matter, will become apparent to persons skilled in the art upon reference to the description of the subject matter. It is therefore contemplated that such modifications can be made without departing from the spirit or scope of the present subject matter as defined.

EXAMPLES

The disclosure will now be illustrated with working examples, which is intended to illustrate the working of disclosure and not intended to take restrictively to imply any limitations on the scope of the present disclosure. Unless defined otherwise, all technical and scientific terms used herein have the same meaning as commonly understood to one of ordinary skill in the art to which this disclosure belongs. Although methods and materials similar or equivalent to those described herein can be used in the practice of the disclosed methods and compositions, the exemplary methods, devices and materials are described herein. It is to be understood that this disclosure is not limited to particular methods, and experimental conditions described, as such methods and conditions may apply.

Conventionally used fuel compositions for cutting and welding applications are associated with high costs, slag formation, difficult to store and transport and back firing tendency, high oxygen and fuel consumption, slow cutting times, etc. Although, recent trends suggest the addition of additives to the fuel compositions have been described in the past, to overcome the cited drawbacks, there still exists a need to develop fuel composition having higher cutting velocities, a lower oxygen and fuel gas consumption, as well as having a low cost of production. In light of the same, the present disclosure provides an additive composition comprising: (a) an organometallic compound; (b) a nitrogen-containing compound; (c) an aryl peroxide, and (d) at least one solvent which when added to a base fuel, such as LPG, not only synergistically improves the properties of the base fuel for use as torch gas for cutting and welding application, but also reduces the consumption of both fuel and oxygen for cutting applications.

Experimental Details

Example 1

Process for Preparation of the Additive Composition

The additive composition is prepared by dissolving 800 mg of iron acetyl acetonate (organometallic compound), 100 mg of N-methylaniline, 100 mg of benzoyl peroxide (aryl peroxide) in 100 mL of a solution comprising a hydrophobic solvent (at least one solvent) (70-90% of naphtha (boiling range: 40-140° C.)/mineral turpentine oil (boiling range: 140-240° C.)/kerosene (boiling range: 140-280° C.), an oxygen containing solvent (1-10% isopropanol), and 0.1-5% of di-methyl aniline (nitrogen containing compound).

Example 2: Process for Preparation of the Fuel Composition

The base fuel is a mixture of C3-C4 hydrocarbons with different composition, such as liquefied petroleum gas (LPG). 10 mL of the additive composition, as prepared in the example 1, was added to an empty LPG cylinder and 5 kg of LPG was introduced into the cylinder. The cylinder was agitated well to mix the additive composition with the LPG. The composition of LPG used in the present disclosure is C4: 40-60%; C3: 25-35%; and C2: <1%.

The volume of solvent in each case was kept constant (0.2%) therefore the total volume was also constant at 10 ml for all compositions for 5 ppm, 10 ppm, 20 ppm. Different additive compositions were made by varying components in the first step of preparation. A 10 ppm solution was prepared, wherein 10 ml of solution in example 1, comprised of 40 mg of iron acetylacetonate, 5 mg of N-methyl aniline and 5 mg of benzoyl peroxide in 10 ml Naptha/MTO. For 20 ppm solution, the 10 ml would have, 80 mg of iron acetylacetonate, 10 mg of N-methyl aniline and 10 mg of benzoyl peroxide in 10 ml naptha/MTO.

Example 3: Evaluating the Effect of Concentration of the Additive Composition, in LPG, on the Fuel Properties The effect of the concentration of the additive composition in LPG (fuel composition), on the fuel performance was further evaluated. For this purpose, 4 fuel compositions, each of varying concentrations of additive composition (LPG with 5 ppm, 10 ppm, 20 ppm, and 50 ppm of the additive composition) was prepared for evaluating the fuel performance. The evaluation was based on the fuel and oxygen consumption, and the time taken for each fuel composition to cut a 1 m long, 25/50/90 mm thick carbon steel metal plate. The performance of each of the fuel compositions was further compared to a base fuel, LPG; and the results are presented below in Table 1-3.

TABLE 1

Cutting data for 25 mm thick and 1-meter long MS plate

| Fuel composition | Fuel consumption, g | Oxygen consumption, g (both heating and cutting) | Total time taken, s |
|---|---|---|---|
| LPG | 34 | 270 | 180 |
| LPG with additive composition (5 ppm) | 30 | 235 | 175 |
| LPG with additive composition (10 ppm) | 27 | 227 | 165 |
| LPG with additive composition (20 ppm) | 26 | 222 | 162 |
| LPG with additive composition (50 ppm) | 24 | 215 | 158 |
| High speed nozzle | 22 | 212 | 132 |

TABLE 2

Cutting data for 50 mm thick and 1-meter long MS plate

| Fuel composition | Fuel consumption, g | Oxygen consumption, g (both heating and cutting) | Total time taken, s |
|---|---|---|---|
| LPG | 50 | 465 | 260 |
| LPG with additive composition (5 ppm) | 43 | 423 | 232 |
| LPG with additive composition (10 ppm) | 40 | 395 | 225 |
| LPG with additive composition (20 ppm) | 37 | 391 | 221 |
| LPG with additive composition (50 ppm) | 36 | 388 | 221 |
| LPG with additive composition (20 ppm) High speed nozzle | 21 | 386 | 212 |

TABLE 3

Cutting data for 90 mm thick and 1-meter-long MS plate

| Fuel composition | Fuel consumption, g | Oxygen consumption, g (both heating and cutting) | Total time taken, s |
|---|---|---|---|
| LPG | 65 | 775 | 310 |
| LPG with additive composition (5 ppm) | 52 | 685 | 272 |
| LPG with additive composition (10 ppm) | 48 | 670 | 265 |
| LPG with additive composition (20 ppm) | 45 | 664 | 262 |
| LPG with additive composition (50 ppm) | 44 | 662 | 262 |
| LPG with additive composition (20 ppm) High speed nozzle | 28 | 654 | 196 |

From a combined reading of Table 1-3, it can be understood that the fuel compositions of the present disclosure reveal that the cutting speed, and consequently the cutting time, is better in comparison to LPG, depending on the thickness of the plate. As evident from the metal cutting data presented in Table 1-3, additive composition at a concentration of 20 ppm in the LPG was found to be optimum. Although reduction in both fuel and oxygen consumption was observed at higher concentrations, the fuel composition was not found to be economically viable at higher concentrations of additive composition in the LPG. The percentage decrease in cutting time, in comparison to the LPG, was found to be between 5-18%. Further, the addition of the additive composition to the LPG has resulted in significant decrease in fuel and oxygen consumption for cutting the metal. A 10-40% decrease in the consumption of fuel and oxygen for cutting, depending on the thickness of the metal. Therefore, the fuel compositions of the present disclosure are economically cheaper in comparison to the LPG.

Example 4: Evaluating the Effect of Additive Composition in LPG on Fuel Properties Six fuel compositions, each comprising a total concentration of 20 ppm of one or more additive components (organometallic compound, N-methyl aniline, aryl peroxide) of the additive composition, were evaluated for their fuel performance; the results of which are provided in Table 4. The solvent used as diluent is MTO (0.2% with respect to LPG). The evaluation was based on the fuel and oxygen consumption, and the time taken for each fuel composition to cut a 1 m long, 50 mm thick carbon steel metal plate. The 6 fuel compositions are as under:

Fuel composition 1: 20 ppm of iron acetyl acetonate in LPG;

Fuel composition 2: 16 ppm of iron acetyl acetonate, and 4 ppm of N-methyl aniline in LPG;

Fuel composition 3: 16 ppm of iron acetyl acetonate, 2 ppm of N-methyl aniline, and 2 ppm of benzoyl peroxide in LPG (iron acetyl acetonate: N-methyl aniline: benzoyl peroxide w/w ratio is 8:1:1);

Fuel composition 4: 10 ppm of N-methyl aniline, and 10 ppm of benzoyl peroxide in LPG;

Fuel composition 5: 10 ppm of iron napthanate, 8 ppm of N-methyl aniline, and 2 ppm of benzoyl peroxide in LPG (iron napthanate: N-methyl aniline:aryl peroxide w/w ratio is 5:4:1); and Fuel composition 6: 10 ppm of ferrocene, 8 ppm of N-methyl aniline, and 2 ppm of benzoyl peroxide in LPG (ferrocene: N-methyl aniline: aryl peroxide w/w ratio is 5:4:1).

TABLE 4

Cutting data for 50 mm thick and 1-meter-long MS plate

| Fuel composition | Fuel composition (Total concentration in LPG is 20 ppm) | | | | | | Oxygen | |
|---|---|---|---|---|---|---|---|---|
| | | Organometallic compound (%) | N-methyl aniline (%) | Benzoyl peroxide (%) | Solvent (%) | Fuel consumption, g | consumption, g (both heating and cutting) | Total time taken, s |
| 1 | Iron acetyl acetonate | 100 (20 ppm) | 0 | 0 | 0.2 | 46 | 446 | 248 |
| 2 | | 80 (16 ppm) | 20 (4 ppm) | 0 | 0.2 | 44 | 440 | 241 |
| 3 | | 80 (16 ppm) | 10 (2 ppm) | 10 (2 ppm) | 0.2 | 37 | 391 | 221 |
| 4 | | 0 | 50 (10 ppm) | 50 (10 ppm) | 0.2 | 50 | 462 | 262 |
| 5 | Iron napthanate | 50 (10 ppm) | 40 (8 ppm) | 10 (2 ppm) | 0.2 | 48 | 452 | 255 |
| 6 | Ferrocene | 50 (10 ppm) | 40 (8 ppm) | 10 (2 ppm) | 0.2 | 50 | 458 | 259 |

From Table 4 it can be observed that the additive components (organometallic compound, N-methyl aniline, and benzoyl peroxide) in the additive composition plays a crucial role in impacting the fuel properties and performance of the fuel composition. For instance, it can be observed that the fuel composition containing all the three additive components, i.e., iron acetyl acetonate, N-methyl aniline, and aryl peroxide (fuel composition 3) showed best results in terms of reduced fuel and oxygen consumption, and greater cutting speed, in comparison to the fuel compositions comprising only one or two additive components from among iron acetyl acetonate, N-methyl aniline, and benzoyl peroxide. Those fuel compositions which did not contain either of organometallic compound, N-methyl aniline, aryl peroxide, or at least two of the three additive components (fuel compositions 1, 2, and 4), showed an increased consumption of fuel and oxygen for cutting the metal sheet. Also, the time taken to cut the metal sheet was substantially higher for these compositions in comparison to the fuel composition 3, which contained all the additive components of the additive composition. This suggests that each additive component in the additive composition, plays a crucial role in effecting the fuel performance, when combined with LPG.

Further, it can also be observed that not w/w ratios of organometallic compound, N-methyl aniline, and benzoyl peroxide are effective in imparting desirable fuel properties. It can be clearly observed that for the fuel composition 5, and 6, where the w/w ratio of organometallic compound:N-methyl aniline:benzoyl peroxide is 5:4:1 in LPG, the fuel and oxygen consumption were markedly higher, with longer cutting time required to cut the metal sheet, in comparison to the fuel composition 3 where the w/w ratio of organometallic compound:N-methyl aniline:benzoyl peroxide in LPG is 8:1:1. This suggests that the fuel composition imparts desirable fuel properties only when the organometallic compound, N-methyl aniline, and benzoyl peroxide are combined in desired w/w ratios and weight percentages, and the same has been experimentally established as described herein.

Advantages of the Present Subject Matter

Overall, the present disclosure discloses an additive composition comprising: (a) an organometallic compound; (b) a nitrogen-containing compound; (c) an aryl peroxide; and (d) at least one solvent, which when added to the at least one base fuel (LPG), not only improves the fuel performance of the LPG for use as torch gas for cutting and welding application with respect to time, and fuel and oxygen consumption. Also, the cutting speed is better in comparison to LPG. The oxygen and fuel consumption by the fuel composition of the present disclosure is 5-37% lower than LPG, depending on the thickness of the plates, without compromising on the cutting time of the plates.

We claim:

1. An additive composition comprising:

(a) an organometallic compound;

(b) a nitrogen-containing compound, wherein the nitrogen-containing compound is an aryl amine having formula Ar—NRR', wherein Ar represents an aryl group, and R and R' groups are independently selected from hydrogen and substituted and unsubstituted alkyl, alkenyl and aryl;

wherein the aryl amine is alkylaniline, dimethylaniline, methylethyl aniline, or methylpropylaniline;

(c) an aryl peroxide; and (d) at least one solvent, wherein the organometallic compound to the nitrogen-containing compound to the aryl peroxide weight ratio is in a range of 7.5:1:1-8.5:1:1, wherein the additive composition is characterised to reduce the consumption of oxygen and fuel by 5-37% as compared to LPG in cutting an MS plate.

2. The additive composition as claimed in claim 1, wherein the organometallic compound is a metal acetylacetonate.

3. The additive composition as claimed in claim 2, wherein a metal in the metal acetylacetonate is selected from a group consisting of Fe, Al, V, Cr, Mn, Fe, Co, Ni, Cu, Zn, La, Ce, and combinations thereof.

4. The additive composition as claimed in claim 1, wherein the aryl peroxide is selected from a group consisting of benzoyl peroxide, tetralin hydroperoxide, (1-naphthyl) (tert-butyl) peroxide, and combinations thereof.

5. The additive composition as claimed in claim 1, wherein the at least one solvent is a combination of: a) a hydrophobic solvent selected from a group consisting of naphtha, gasoline, mineral turpentine oil, kerosene, and combinations thereof; and b) an oxygen-containing solvent selected from $C_{1-6}$ alcohols, $C_{3-6}$ ketones or $C_{2-6}$ ethers.

6. A process for obtaining the additive composition as claimed in claim 1, said process comprising:

a) obtaining the organometallic compound;

b) obtaining the nitrogen-containing compound;

c) obtaining the aryl peroxide; and d) contacting the organometallic compound, the nitrogen-containing compound, the aryl peroxide and the at least one solvent to obtain the additive composition.

7. A fuel composition comprising:

a) at least one base fuel;

b) an additive composition as claimed in claim 1.

8. The fuel composition as claimed in claim 7, wherein the organometallic compound has a concentration of 16 ppm with respect to the at least one base fuel; the nitrogen-containing compound has a concentration of 2 ppm with respect to the at least one base fuel; and c) an aryl peroxide has a concentration of 2 ppm with respect to the at least one base fuel.

9. A process for obtaining the fuel composition as claimed in claim 7, said process comprising:

a) obtaining the organometallic compound;

b) obtaining the nitrogen-containing compound;

c) obtaining the aryl peroxide; and d) contacting the organometallic compound, the nitrogen-containing compound, the aryl peroxide and the at least one solvent in the presence of at least one base fuel to obtain the fuel composition.

10. A method for using the fuel composition as claimed in claim 7, in metal cutting and welding applications, the method comprising:

passing the fuel composition and oxygen gas on a metal plate, wherein the metal plate is a carbon steel metal plate having a thickness in a range of 25 mm to 90 mm, wherein the fuel composition comprises an additive composition in a concentration 5 ppm to 50 ppm, wherein an amount of oxygen gas required is in a range of 212 g to 775 g, and wherein the process requires the fuel composition in an amount 21 g to 65 g.

* * * * *